US008701640B2

(12) United States Patent
Smit

(10) Patent No.: US 8,701,640 B2
(45) Date of Patent: Apr. 22, 2014

(54) SPECIALIZED FLYING DISCS AND DISC LAUNCHING DEVICES

(76) Inventor: Adriaan Smit, Redondo Beach, CA (US)

( * ) Notice: Subject to any disclaimer, the term of this patent is extended or adjusted under 35 U.S.C. 154(b) by 193 days.

(21) Appl. No.: 13/369,170

(22) Filed: Feb. 8, 2012

(65) Prior Publication Data

US 2012/0199105 A1 Aug. 9, 2012

Related U.S. Application Data

(60) Provisional application No. 61/440,793, filed on Feb. 8, 2011.

(51) Int. Cl.

| | |
|---|---|
| ***A63H 33/18*** | (2006.01) |
| ***F41B 3/04*** | (2006.01) |
| ***A63B 65/00*** | (2006.01) |
| ***A63B 67/06*** | (2006.01) |

(52) U.S. Cl.

CPC . *A63H 33/18* (2013.01); *F41B 3/04* (2013.01); *A63B 65/00* (2013.01); *A63B 67/06* (2013.01)

USPC ..... 124/5; 124/1; 124/79; 124/81; 473/588; 473/589

(58) Field of Classification Search

CPC ..... A63B 65/00; A63B 67/06; F41B 3/04; A63H 33/18

USPC ..... 124/1, 5, 79, 81; 473/588, 589

See application file for complete search history.

(56) References Cited

U.S. PATENT DOCUMENTS

| | | | | | |
|---|---|---|---|---|---|
| 2,493,245 | A | * | 1/1950 | Hansen | 124/5 |
| 2,690,339 | A | * | 9/1954 | Hall | 473/514 |
| 2,886,320 | A | * | 5/1959 | Hennik | 473/510 |
| 2,953,378 | A | * | 9/1960 | Veigne, Jr | 473/514 |
| 3,537,438 | A | * | 11/1970 | Reed | 124/5 |
| 3,707,061 | A | | 12/1972 | Collette et al. | |
| 3,802,117 | A | | 4/1974 | Engelhardt | |
| 3,841,292 | A | | 10/1974 | Hoffman | |
| 3,901,208 | A | * | 8/1975 | Laporte et al. | 124/5 |
| 3,959,917 | A | * | 6/1976 | Dawson | 446/37 |
| 4,030,472 | A | * | 6/1977 | Watkins | 124/5 |
| 4,076,004 | A | * | 2/1978 | Huelskamp | 124/5 |
| 4,157,828 | A | * | 6/1979 | Cosmopulos | 473/510 |
| 4,162,081 | A | | 7/1979 | Joseph | |
| 4,165,580 | A | | 8/1979 | Miura | |
| 4,222,361 | A | * | 9/1980 | Jackson et al. | 124/5 |
| 4,233,952 | A | * | 11/1980 | Perkins | 124/5 |
| 4,347,828 | A | * | 9/1982 | Bridgeman | 124/5 |
| 4,466,212 | A | | 8/1984 | Lehman | |
| 4,549,521 | A | * | 10/1985 | Hargrave, Jr. | 124/5 |
| 4,730,595 | A | * | 3/1988 | Glass et al. | 124/5 |

(Continued)

*Primary Examiner* — Alvin Hunter
*Assistant Examiner* — A. N.
(74) *Attorney, Agent, or Firm* — Mohr Intellectual Property Law Solutions, PC

(57) ABSTRACT

The present disclosure is directed to specialized flying discs and launching devices having a launching arm that can be held by a user, the arm being coupled to a flying disc via a coupler disposed at the launching end of the arm, and an attachment member disposed on the periphery of the flying disc. When swung by the user with appropriate force, the disc becomes un-coupled from the arm and takes flight. In some examples, the attachment members define distinct attachment nodes disposed within attachment openings. In some other examples the attachment member defines a concentric ring disposed on the periphery of the disc.

20 Claims, 6 Drawing Sheets

(56) References Cited

U.S. PATENT DOCUMENTS

| | | | | | |
|---|---|---|---|---|---|
| 4,883,290 | A | | 11/1989 | Landa | |
| 4,919,083 | A | | 4/1990 | Axelrod | |
| 4,955,842 | A | | 9/1990 | Marcotti | |
| 4,974,574 | A | * | 12/1990 | Cutlip | 124/5 |
| 4,984,556 | A | * | 1/1991 | Glass et al. | 124/5 |
| 5,029,703 | A | | 7/1991 | Dulyea et al. | |
| 5,078,637 | A | | 1/1992 | McFarland | |
| 5,088,469 | A | * | 2/1992 | Hargrave | 124/5 |
| 5,181,500 | A | * | 1/1993 | Chamberland | 124/5 |
| 5,201,526 | A | | 4/1993 | Ketcham, Jr. | |
| 5,254,077 | A | | 10/1993 | Nottingham et al. | |
| 5,282,634 | A | * | 2/1994 | Chamberland | 473/510 |
| 6,076,829 | A | * | 6/2000 | Oblack | 273/317 |
| 6,106,355 | A | | 8/2000 | Hoerner | |
| 6,193,620 | B1 | * | 2/2001 | Tarng | 473/465 |
| 6,477,745 | B2 | | 11/2002 | Strebl | |
| 6,622,352 | B2 | | 9/2003 | Herron | |
| 6,860,783 | B1 | | 3/2005 | Kucha et al. | |
| 6,939,191 | B1 | | 9/2005 | Wu | |
| 7,665,453 | B1 | * | 2/2010 | D'Agostino | 124/5 |
| 7,665,454 | B1 | * | 2/2010 | D'Agostino | 124/5 |
| 7,677,994 | B2 | * | 3/2010 | Matsumoto et al. | 473/510 |
| 7,686,001 | B2 | * | 3/2010 | Fitt | 124/5 |
| 7,794,341 | B2 | * | 9/2010 | Tarng et al. | 473/465 |
| 7,895,995 | B2 | * | 3/2011 | Simon | 124/5 |
| 7,900,617 | B1 | * | 3/2011 | Kersh | 124/5 |
| 8,028,684 | B1 | * | 10/2011 | Weissmann et al. | 124/5 |
| 8,327,832 | B2 | * | 12/2012 | Henry | 124/5 |
| 8,387,601 | B1 | * | 3/2013 | Christensen | 124/5 |
| 8,511,292 | B2 | * | 8/2013 | Black et al. | 124/5 |
| 8,539,939 | B2 | * | 9/2013 | Minneman et al. | 124/5 |
| 2003/0045200 | A1 | * | 3/2003 | Tarng et al. | 446/46 |
| 2004/0077255 | A1 | | 4/2004 | Tarng | |
| 2005/0070198 | A1 | * | 3/2005 | Pickering et al. | 446/71 |
| 2008/0072885 | A1 | * | 3/2008 | Fitt | 124/5 |
| 2009/0115211 | A1 | | 5/2009 | Johnson | |
| 2009/0120419 | A1 | * | 5/2009 | Simon | 124/5 |
| 2009/0143175 | A1 | * | 6/2009 | Tarng et al. | 473/470 |
| 2011/0017184 | A1 | * | 1/2011 | Henry | 124/5 |
| 2011/0100345 | A1 | * | 5/2011 | Minneman et al. | 124/5 |
| 2012/0048251 | A1 | * | 3/2012 | Oblack et al. | 124/5 |

* cited by examiner

SPECIALIZED FLYING DISCS AND DISC LAUNCHING DEVICES

CROSS REFERENCE TO RELATED APPLICATIONS

This application claims priority to copending U.S. Application, Ser. No. 61/440,793, filed on Feb. 8, 2011, which is hereby incorporated by reference for all purposes.

BACKGROUND

The present disclosure relates generally to projectile launching toys. In particular, the present disclosure describes specialized flying discs and disc launching devices configured to launch and retrieve flying discs without requiring direct user contact with the disc.

Commonly known flying discs like Frisbee™, or similar but more unique discs like the Aerobic™, have been around for some time. These flying discs are used to play catch, disc sports, and even fetch with animals. The discs are typically thrown, caught and retrieved from the ground by hand. Known flying discs an launching devices are not entirely satisfactory for the range of applications in which they are employed. For example, disc launching devices often include needlessly complex designs that reduce their entertainment value. Such complex designs often make it difficult to launch a disc and frustrate the user. Other designs do not provide the user with sufficient stability and control when a disc is launched.

In addition to complex designs, existing devices fail to provide sufficient launching power to propel the disc any considerable distance. Awkward launching devices and hand throwing discs can make propelling the disc difficult. Poorly designed devices and hand throwing discs also cause strain the user. Existing devices and launching approaches do not offer the leverage necessary to propel the disc with sufficient speed to keep the disc in the air.

Known disc launching devices also do not satisfactorily retrieve flying discs n the ground after being launched. Specifically, many disc launching devices are unable to retrieve flying discs when the disc is in difficult to reach locations and/or when the disc is laying with its top facing the ground. Without sufficient means for retrieval, existing devices force the user to retrieve the disc by hand. Often, dirt, water, mud, or other substances make handling the disc undesirable,

SUMMARY

The present disclosure is directed to specialized flying discs and launching devices having a launching arm that can be held by a user, the arm being coupled to a flying disc via a coupler disposed at the launching end of the arm, and an attachment member disposed on the periphery of the flying disc. When swung by the user with appropriate force, the disc becomes un-coupled from the arm and takes flight. In some examples, the attachment members define distinct attachment nodes disposed within attachment openings. In some other examples the attachment member defines a concentric ring disposed on the periphery of the disc.

DETAILED DESCRIPTION

Figure 1:
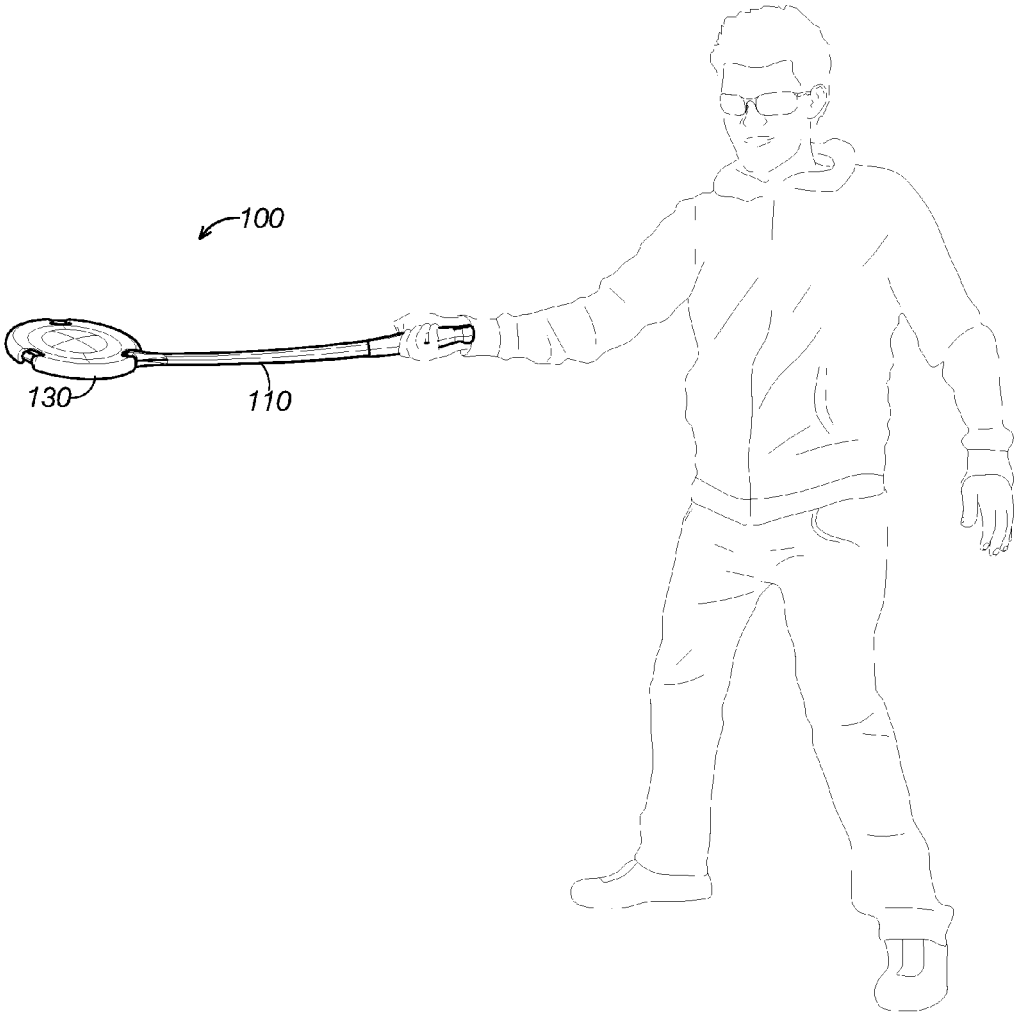
FIG. 1 is a perspective view of a first example of a disc launching device being used by a user.
Figure 2:
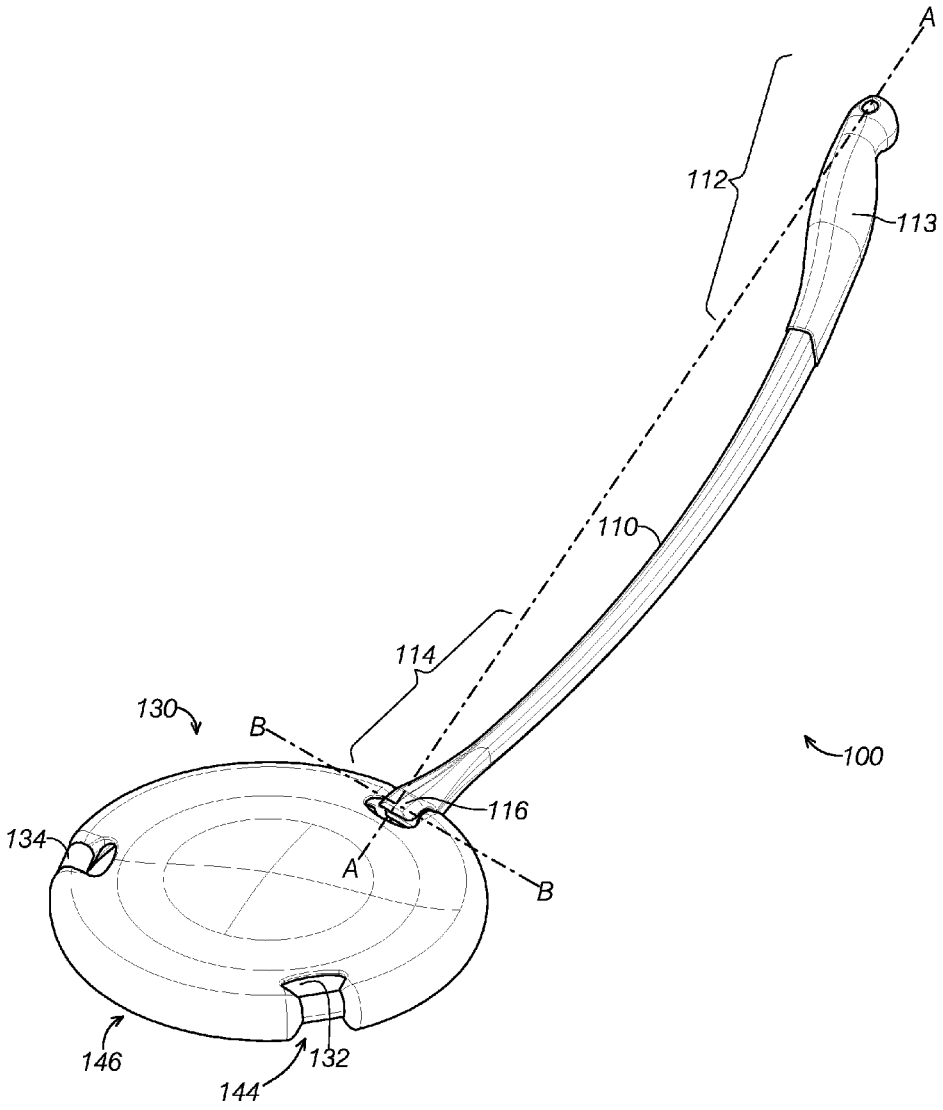
FIG. 2 is a perspective view of the disc launching device shown in FIG. 1.

The disclosed specialized flying discs and launching devices will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various specialized flying discs and launching devices are provided. Related features in the examples may be identical, similar, or dissimilar in different examples. For the sake of brevity; related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-7, disc launching device 100 includes an arm 110 and a disc 130. Disc launching device 100 allows a user to launch disc 130 without direct user contact with the flying disc. Additionally, disc launching device 100 allows a user to retrieve disc 130 without the user contacting disc 13C with his hands. Disc launching device 100 can be employed to launch flying discs when playing catch with other users, while playing fetch with animals, and in various disc sports. Launching device 100 can make propelling a flying disc easier and more comfortable than conventional launching methods and devices.

The arm 110 of disc launching device 100 is capable of adding leverage, reach, spin, speed, and thrust to a disc 130 and causing disc 130 to fly. Arm 110 can also aid in recovery of the disc from the ground, or from hard-to-reach places. The arm includes a gripping end 112, a launching end 114, and the launching end having a coupler 116, coupled to a flying disc 130. A longitudinal axis A of the arm generally extends from gripping end 112 to launching end 114.

As shown in FIGS. 1-7, disc 130 includes a central body with a top side and a bottom side opposing one another and a lip extending around the periphery of the central body. In the example shown in FIGS. 1-7, disc 130 resembles a modified Frisbee™ throwing disc. In another example, the disc does not include a lip extending from the central body, but instead is a substantially planar disc. In et other examples the central body defines an aperture. In other examples, any body sufficient to support the disc while coupled or in flight is adequate for use.

Figure 6:
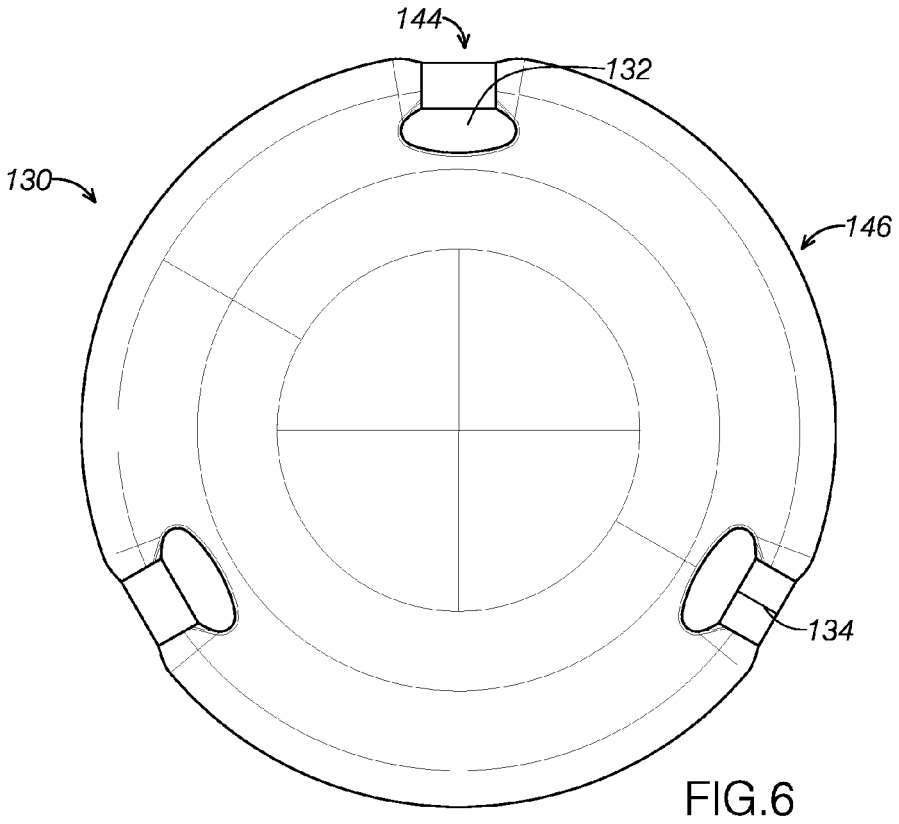
FIG. 6 is a top view of the flying disc of the disc launching apparatus shown in FIGS. 1-3, depicting a plurality of discrete attachment members.
Figure 7:
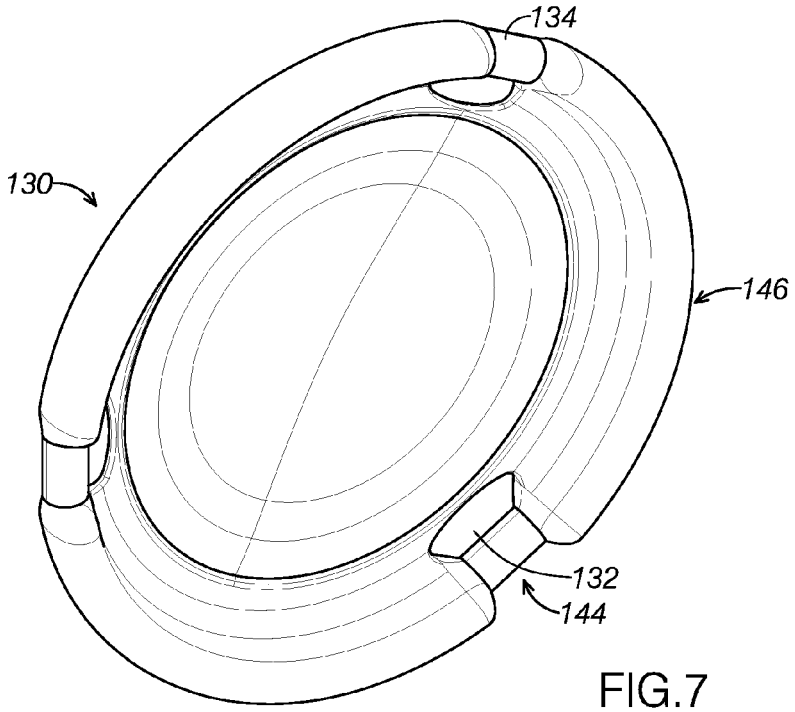
FIG. 7 is a perspective view of the bottom side of the flying disc shown in FIG. 1.

As FIG. 6 illustrates, disc 130 includes a plurality of attachment member openings 132, each opening 132 containing an attachment member 134. In the instant example, Disc 130 is shaped substantially similar to a paraboloid flying disc. In other examples the shape of the disc somewhat square. In yet other instances the shape of the disc x-shaped.

Disc 130 may be weighted according to desired flight characteristics. In this example disc 130 is a medium weight disc. In another embodiment, the disc is weighted snore heavily. In yet another embodiment, the disc is lighter resulting in differing flight characteristics.

The aerodynamic design of disc 130 is conducive to achieving stable flight when thrown or launched with a selected amount of force and spin. In some examples, the design is more or less aerodynamic, providing a selectable number of flight characteristics.

The parabolic shape of the central body of disc 130 results in a convex top side and a concave bottom side. In the instant example, disc 130 is sufficiently concave to provide for lift when the disc is thrown. This lift can allow increased hang time for the launched disc. In another example the concave shape is significantly reduced to an almost uniformly flat body. Such variations in the disc size and concave shape create more distinct flying characteristics and trajectory patterns. The aerodynamic considerations of the flying discs in all examples are selectable according to desired trajectory and flight characteristics.

In the example shown in FIGS. 1-7, Disc 130 is constructed out of a durable nylon material suitable for prolonged use. In another example, the disc is constructed from a rigid internal structure covered by a flexible external structure. In yet another example, the disc is constructed from lightweight metal. In various other examples the disc is constructed from materials sufficiently rigid to allow the disc to couple, uncouple, and take flight.

The durability and material construction of certain disc examples make it especially suitable for use as a dog toy. Yet others are suitable for launching between users. Other discs are suitable for various disc sport applications.

FIG. 6 shows that attachment member openings 132 are voids spaced interstitially around the perimeter of disc 130. Attachment member openings 132 are shaped to receive the full width of a coupler 116 of arm 110. Attachment member openings 132 provide arm 110 and coupler 116 with access to attachment member 134 from a variety of angles.

Figure 3:
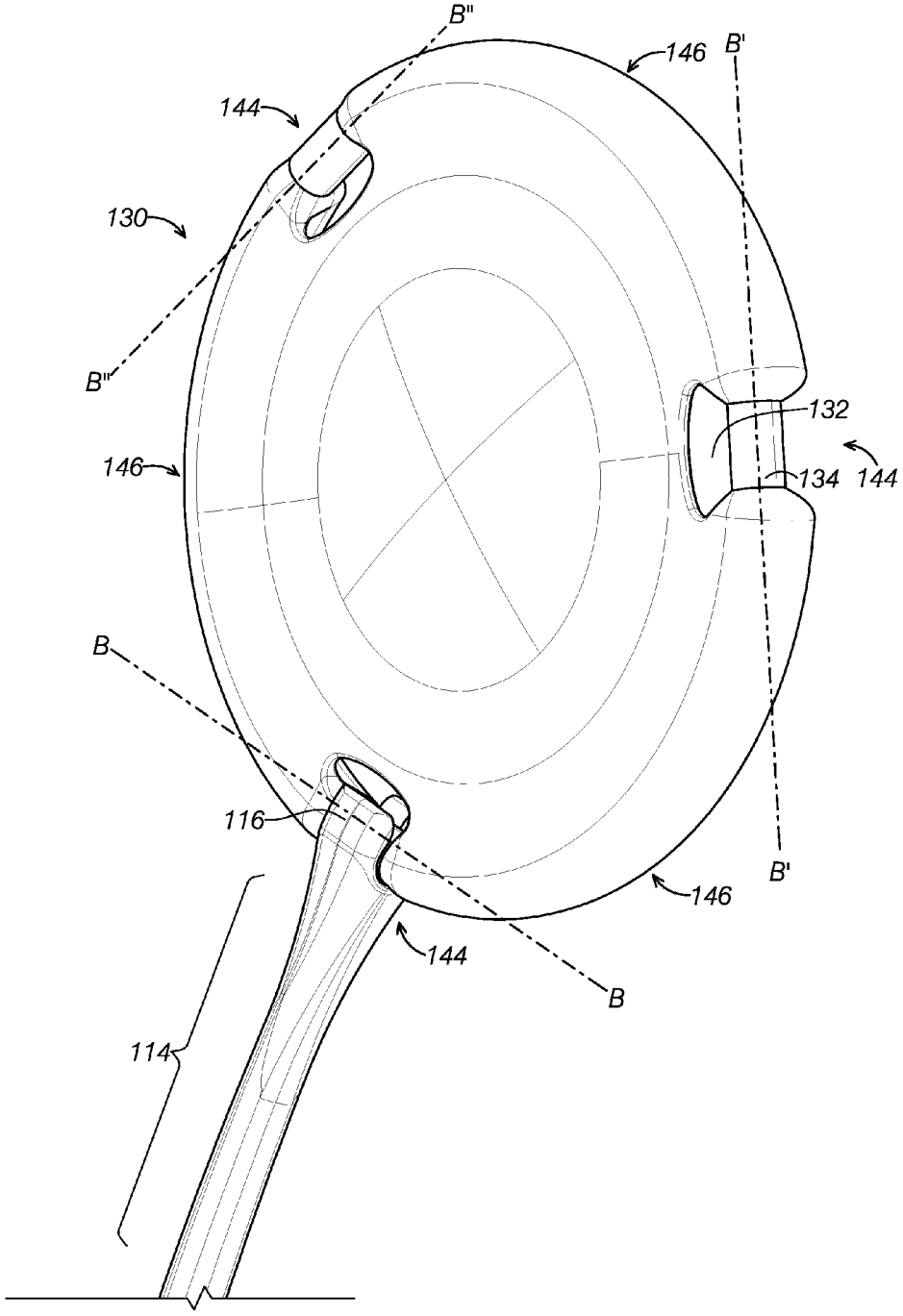
FIG. 3 is a close-up, top view of a launching end of an arm of the disc launching device shown in FIG. 1 coupled to a flying disc.

As FIGS. 3 and 6 illustrate, attachment member 134 define cylinders that extend across attachment member openings 132 along a path substantially aligned with the perimeter of disc 130. In the instant example. Attachment member 134 are composed of a material with a selected rigidity that allows coupling and decoupling of attachment member 134 from coupler 116 of arm 110.

The shape of attachment members in the instant example is largely cylindrical to match the shape of coupler 116. In another example, the attachment members have an elliptical cross section. In a different example, the attachment members have a teardrop cross section. In yet other examples, the attachment members are any shape that allows coupling and un-coupling of the disc from arm 110.

Attachment member opening 132 allow coupler 116 of arm 110 to engage one of the attachment members 134 from any angle around a longitudinal axis B (B, B', and B") of attachment members 134. As a result, arm 110 may selectively engage attachment member 134 from positions approaching the top side or bottom side of disc 130 or around the periphery of disc 130.

The plurality of attachment members 134 interspersed around the perimeter of disc 130 afford arm 110 and coupler 116 greater access to attachment members 134 when directly engaging disc 130 from the ground. The spacing of attachment members 134 around the perimeter and the greater access to attachment members 134 through attachment member openings 132 collectively allow arm 110 to directly engage disc 130 from a variety of landing positions and define discrete coupling regions 144 and discrete non-coupling regions 146.

Turning our attention now to FIGS. 1-5, arm 110 includes a gripping end 112, a launching end 114, and a coupler 116. Arm 110 is an elongate member that includes a gripping end 112 and a launching end 114, on which coupler 116 is disposed, opposite the gripping end. Arm 110 is configured to support disc 130 and to launch disc 130 when swung by a user.

Gripping end 112 is held by a user when swinging arm 110 causing launching end 114 to gain speed. In the instant example, gripping end 112 includes a handle 113 contoured to comfortably fit a user's hand profile. In another example, handle 113 is a malleable grip. Any conventional handle suitable for manipulating the launching device may be used. In yet other examples the gripping end 112 of arm 110 terminates without a handle.

Figure 4:
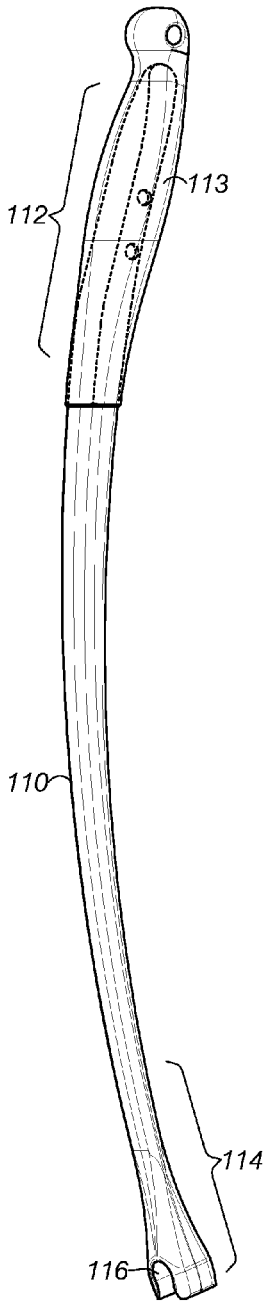
FIG. 4 is an elevation view of the arm portion of the disc launching device shown in FIG. 3.

Turning specifically to FIG. 4, arm 110 defines an elongate member. In this example, arm 110 has a slight bend from gripping end 112 to launching end 114 creating an overall curved arm 110. The aggressive level of the curve allows for certain launch characteristics. In another example, the arm is bent more aggressively allowing for a selectable launch angle of disc 130. In a different example the arm is substantially flat, achieving yet other launch and handling characteristics. In any example, the arm may have any level of curvature sufficient to achieve user desired launch and handling characteristics.

Arm 110 is sufficiently rigid to withstand the force necessary to launch disc 130 when arm 110 is swung. Although arm 110 may flex when swung with sufficient force, it is sufficiently resilient to return to its original shape after disc 130 is launched.

As shown in FIGS. 1-5, coupler 116 is connected to launching end 114 of arm 110, opposite gripping end 112. Coupler 116 includes a palm portion 118, a first finger 120, and a second finger 122 collectively defining a channel 124. The individual components of coupler 116 combine to receive attachment members 134.

A disc coupling event occurs when attachment members 134 are received into coupler 116. On the other hand a decoupling event occurs when disc launching, device 100 is swung with sufficient force to cause coupler 116 to disengage attachment member 134. Upon coupling, disc 130 becomes oriented along the swing plane of disc launching device 100.

Turning attention to FIG. 3, palm portion 118 is shown forming the base of coupler 116 distal to launching end 114 of arm 110. In the instant example, palm portion 118 is largely cylindrical in shape and is so shaped to receive attachment members 134. In another example, the palm portion is square. In a different example, the palm portion is oval. In yet other examples, the palm portion is any shape complimentary to the attachment members, that is capable of having a coupling and de-coupling event.

Looking again to FIG. 3, first finger 120 and second finger 122 both extend from palm portion 118 away from arm 110 to engage a segment of attachment member 134. First finger 120 and second finger 122 collectively apply a clamping force onto attachment member 134 disposed between them, in this example, first finger 120 and second finger 122 are positioned to fit snugly around attachment member 134, snapping into place over the attachment member during a coupling event. The resiliency level of the two fingers determines in part the release characteristics of the de-coupling event; a more resilient finger configuration requiring greater swing force to cause the de-coupling event.

Figure 5:
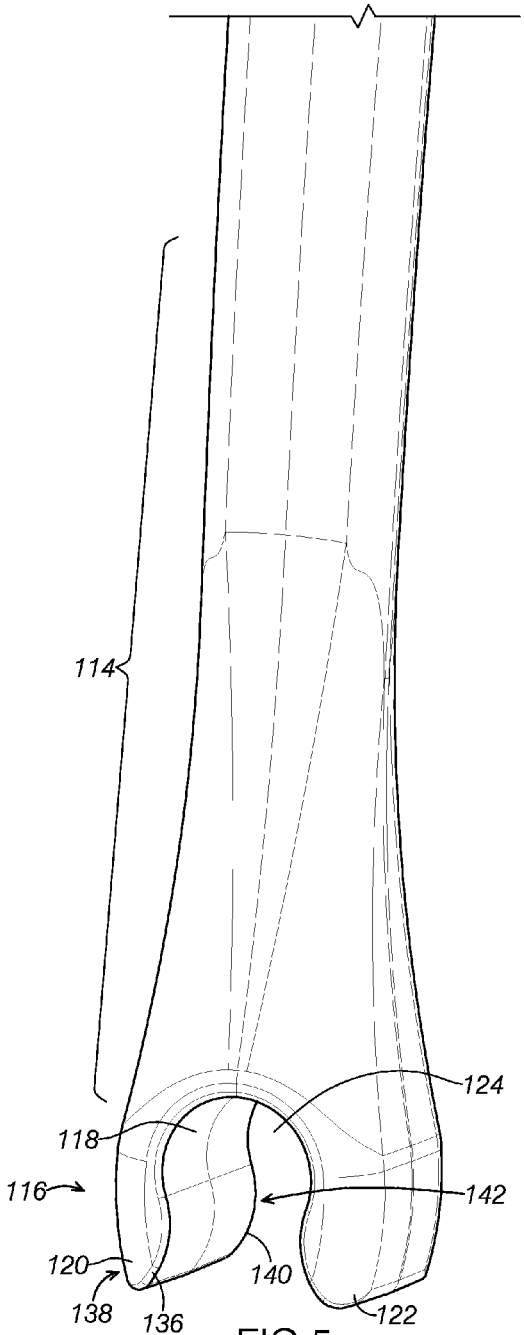
FIG. 5 is a close up view of a coupler, disposed on the launching end of the disc launching device shown in FIG. 4, depicting a first finger, a second finger, a palm portion, and a channel.

In the example shown in FIGS. 1-7, first finger 120 and second finger 122 are configured with varying resiliencies to impart user selectable de-coupling and launch characteristics. FIG. 5 for example shows first finger 120 and second finger 122 having a leading edge 136 on a first face 138 of first and second finger 120 and 122, while a second face 142 of first and second finger 120 and 122 is a trailing edge 140. In this example, the leading edge of first finger 120 and second finger 122 is slightly more resilient than the trailing edge of both fingers. This configuration imparts spin on the disc during the de-coupling event by allowing the trailing edges to decouple from attachment members 134 first.

In another example where different release characteristics are desired, the resiliencies of the first and second fingers are the same. In a different example, the resiliency levels of both fingers is very high, requiring a larger amount of force for decoupling and causing increased disc speed and distance. In certain examples, the resiliencies are selected to inhibit the coupler from disengaging the attachment members before intended by the user. In yet other examples, the resiliencies are selected based upon the mass of the disc and the angular acceleration of a desired swing.

In the instant embodiment, first finger 120 and second finger 122 are made from a semi-rigid plastic material. In another example, the fingers are made from polyurethane. In a different example, the fingers are constructed from polyvinyl chloride. In yet other examples, the fingers are constructed from any material sufficiently resilient to accomplish a coupling and de-coupling event.

As can be seen in FIG. 5, the instant embodiment includes a channel 124 defined by the space within the palm portion 118, and first finger 120 and second finger 122. Specifically, channel 124 defines a substantially cylindrical channel or bearing that is complimentarily shaped and sized with attachment members 134. In certain other examples, the channel defines any shape complimentary to the attachment members.

As a result of channel 124's complimentary shape, disc 130 selectively rotates transverse the swing plane while engaged within coupler 116. Such selective rotation may be particularly useful when arm 110 is used to engage disc 130 directly from the ground and disc 130 is not properly aligned with arm 110.

Further, the cylindrical bearing defined by channel 124 enables disc 130 to rotate relative to coupler 116 as launching device 100 is swung to launch disc 130. As launching device 100 is swung, disc 130 naturally rotates due to the rotational dynamics in the cylindrical bearing to a position where palm portion 118, first finger 120 and second finger 122 are substantially horizontal. By rotating to a substantially horizontal orientation before being released by coupler 116, disc 130 is thrown in a stable orientation conducive for flight.

Upon launching disc 130 in a de-coupling event, a user holding gripping end 112 and swings arm 110 in a swing direction until a threshold force acting on coupler 116 is achieved. The user's swing applies forward momentum to the disc 130. When arm 110 is swung with sufficient force, the resulting angular momentum acting on disc 130 overcomes the clamping force of coupler 116 and disc 130 de-couples and takes flight.

As disc 130 is launched from launching end 114, launching end 114 applies a forward momentum on disc 130 substantially aligned with the swing direction. This forward momentum is focused on the center of disc 130, causing disc 130 to launch substantially aligned with the swing direction. Additionally, coupler 116 applies a force to attachment members 134 in a direction substantially opposite the swing direction and focused substantially at the perimeter of disc 130. The misalignment of the forward momentum applied by launching end 114 and the opposing force applied by coupler 116 causes disc 130 to spin as it launched, leading to greater horizontal stability during flight. Increasing the rate at which the disc spins has been observed to increase the stability of the disc in flight.

Figure 8:
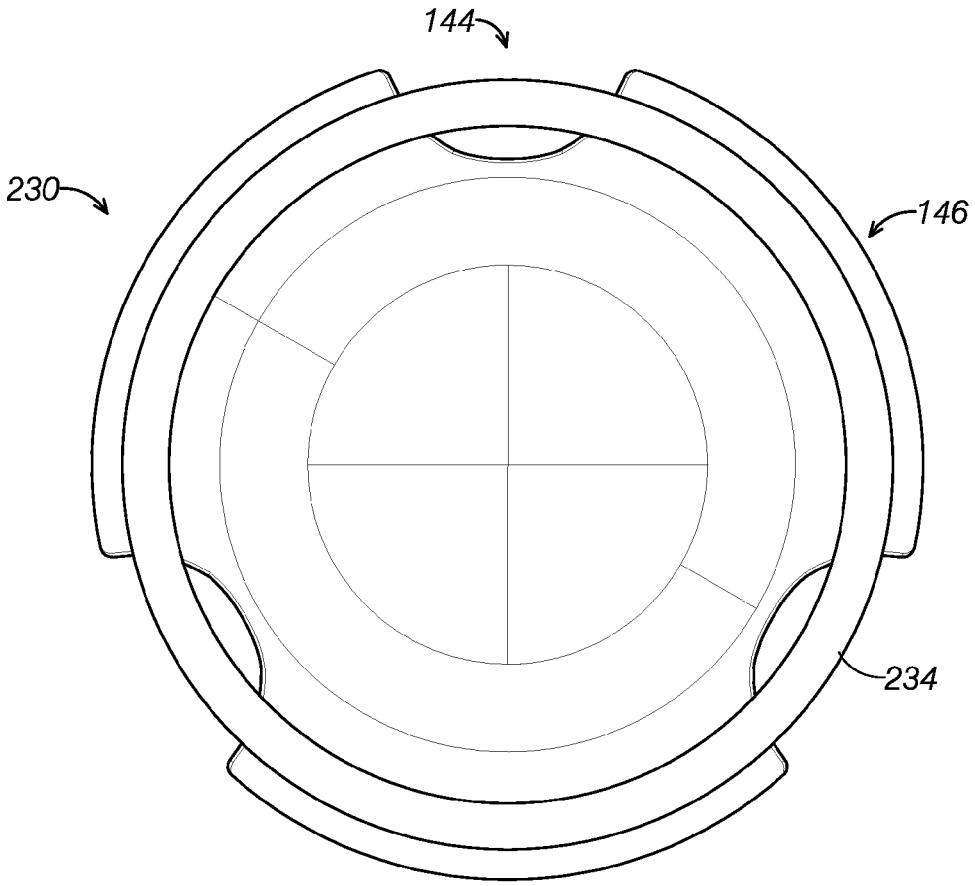
FIG. 8 is a top view of a second example of a flying disc portion of a disc launching device similar to that shown in FIG. 6, depicting a ring shaped attachment member.

Turning attention to FIG. 8, a second example of a disc is described. Disc 230 includes many similar or identical features to disc 130 combined in unique and distinct ways. Thus, for the sake of brevity, each feature of disc 230 will not be redundantly explained. Rather, key distinctions between disc 230 and disc 130 will be described in detail and the reader should reference the discussion above for features substantially similar between the two discs.

As shown in FIG. 8, disc 230 has an attachment member defining a ring 234. A key distinction between disc 130 and disc 230 is the attachment member. In contrast to disc 130, which includes a plurality of discrete attachment members 134 disposed on the periphery of the disc 130, disc 230 includes an attachment member ring 234 extending around the entire periphery of the disc. As shown in FIG. 8, attachment member ring 234 is disposed around the periphery of disc 230. This placement allows attachment member ring 234 to be coupled from many different directions and is not limited to the discrete attachment members 134 of disc launching device 100.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious, inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A disc launching device, comprising:

an elongate launcher configured to be swung by a user, including:

an arm having a gripping end and a launching end opposite the gripping end; and a coupler disposed at the launching end of the arm, the coupler including:

a palm portion;

a first finger extending from the palm portion, the first finger being resilient; and a second finger spaced from the first finger and extending from the palm portion, the palm portion, the first finger, and the second finger collectively defining a channel that is open opposite the palm portion; and a disc selectively coupled to the coupler, the disc including:

a substantially planar body defining an outer radial periphery; and one or more attachment members disposed proximate the outer radial periphery of the body and being complimentarily configured with the channel defined by the coupler, the one or more attachment members defining a plurality of discrete coupling points;

wherein the coupler is configured to retain the attachment member in the channel when the disc is at rest or moving below a threshold angular velocity and to selectively release the attachment member when the user swings the disc above a threshold angular velocity, and one of a plurality of discrete non-coupling regions is disposed between each of the plurality of discrete coupling points.

2. The disc launching device of claim 1, wherein the disc further comprises a lip extending around at least a portion of the outer radial periphery of the body.

3. The disc launching device of claim 1, wherein the arm includes a handle at the gripping end and the resilient coupler and the handle lie substantially along a swing plane that is substantially coplanar with the substantially planar body as the user swings the elongate launcher from the handle.

4. The disc launching device of claim 1, wherein the arm extends in an arch.

5. The disc launching device of claim 1, wherein the arm is flexible.

6. The disc launching device of claim 1, wherein the cross-section of the arm is tapered from the gripping end towards the launching end.

7. The disc launching device of claim 1, wherein the coupler defines a bearing allowing the coupling member to rotate within the channel to allow the disc to pivot around the longitudinal axis of the one or more attachment members, changing an angle of the planar body relative to the arm of the elongate launcher.

8. The disc launching device of claim 1, wherein the second finger is resilient.

9. The disc launching device of claim 1, wherein the coupler includes a leading edge at a first face of the first finger and the second finger and a trailing edge at a second face of the first finger and the second finger, the first face being on an opposite side of the coupler relative to the second face, the trailing edge having a different resiliency than the leading edge.

10. The disc launching device of claim 9, wherein the resiliency of the leading edge is greater than the resiliency of the trailing edge.

11. The disc launching device of claim 9, wherein the resiliency of the leading edge and the resiliency of the trailing edge are configured to release the attachment member at different intervals to impart spin on the disc.

12. The disc launching device of claim 1, wherein the plurality of discrete coupling points comprise a first coupling point and a second coupling point spaced from the first coupling point around the outer radial periphery of the body, a region on the outer radial periphery of the body between the first coupling point and the second coupling point being one of the plurality of non-coupling regions.

13. The disc launching device of claim 1, wherein the one or more attachment members are substantially cylindrical.

14. The disc launching device of claim 1, wherein the one or more attachment members define a ring.

15. The disc launching device of claim 14, wherein the ring is exposed in distinct locations proximate the outer radial periphery of the substantially planar body to receive the coupler.

16. The disc launching device of claim 15, wherein the distinct locations define a cutout in the substantially planar body of the disc, the cutout substantially coplanar with the substantially planar body, the cutout creating a space around the exposed ring configured to allow the coupler to engage the ring in various positions, the substantially planar body disposed at various angles relative to the arm of the elongate launcher, the various angles corresponding to the various positions, a longitudinal axis of the arm perpendicular to the outer radial periphery in any one of the various positions.

17. A disc launching device, comprising:

an elongate launcher configured to be swung by a user, including:

an arm having a gripping end and a launching end opposite the gripping end, an arm longitudinal axis generally extending from the gripping end to the launching end; and a resilient coupler disposed at the launching end of the arm and defining a channel with a channel opening distal the arm; and a disc selectively coupled to the resilient coupler, the disc including:

a substantially planar body defining an outer radial periphery; and at least one attachment member disposed proximate the outer radial periphery of the substantially planar body and being complimentarily configured with the channel defined by the resilient coupler, the at least one attachment member having an attachment member longitudinal axis that is substantially coplanar with the substantially planar body, the at least one attachment member configured to extend through the channel along the attachment member longitudinal axis when the disc is coupled to the resilient coupler;

wherein the coupler is configured to retain the attachment member in the channel when the disc is at rest or moving below a threshold angular velocity and to selectively release the attachment member when the user swings the disc above a threshold angular velocity, and wherein the arm longitudinal axis of the elongate launcher is substantially perpendicular relative to the attachment member longitudinal axis when the disc is coupled to the elongate launcher.

18. The disc launching device of claim 17, wherein the coupler defines a bearing allowing the at least one attachment member to rotate within the channel to allow the substantially planar body to pivot around the attachment member longitudinal axis and change an angle of the planar body relative to the arm of the elongate launcher.

19. The disc launching device of claim 17, wherein the coupler and the attachment member are configured to engage in various positions, the substantially planar body disposed at various angles relative to the arm of the elongate launcher, the various angles corresponding to the various positions.

20. The disc launching device of claim 17, wherein the at least one attachment member defines a plurality of discrete coupling points, one of a plurality of discrete non-coupling regions disposed between each of the plurality of discrete coupling points.

* * * * *